US005576266A

United States Patent [19]

Flosenzier et al.

[11] Patent Number: 5,576,266

[45] Date of Patent: Nov. 19, 1996

[54] MAGNETIC LAYER IN DYE-DONOR ELEMENT FOR THERMAL DYE TRANSFER

[75] Inventors: Linda Flosenzier; Robert O. James; Philip G. Walker, all of Rochester, N.Y.

[73] Assignee: Eastman Kodak Company, Rochester, N.Y.

[21] Appl. No.: 599,692

[22] Filed: Feb. 12, 1996

[51] Int. Cl.[6] ..... B41M 5/035; B41M 5/38

[52] U.S. Cl. ..... 503/227; 428/195; 428/403; 428/694 TB; 428/694 BB; 428/694 BA; 428/913; 428/914

[58] Field of Search ..... 428/195, 206, 428/341, 342, 694 TB, 694 BB, 694 BA, 913, 914; 503/227; 8/471

[56] References Cited

U.S. PATENT DOCUMENTS 5,342,671 8/1994 Stephenson ..... 428/195

FOREIGN PATENT DOCUMENTS

02/054798 11/1990 Japan ..... 503/227

*Primary Examiner*—B. Hamilton Hess
*Attorney, Agent, or Firm*—Harold E. Cole

[57] ABSTRACT

A dye-donor element for thermal dye transfer comprising a support having on one side thereof a dye layer and on the other side thereof in the direct opposite area to at least a portion of the dye layer, a magnetic recording layer and a slipping layer, in that order.

12 Claims, No Drawings

MAGNETIC LAYER IN DYE-DONOR ELEMENT FOR THERMAL DYE TRANSFER

This invention relates to a dye-donor element used in thermal dye transfer, and more particularly to the use of a magnetic recording layer underneath a slipping layer on the back side thereof.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method for Controlling A Thermal Printer Apparatus," issued Nov. 4, 1986, the disclosure of which is hereby incorporated by reference.

A slipping layer is usually provided on the backside of the dye-donor element to prevent sticking to the thermal head during printing. A subbing layer is also usually needed to promote adhesion between the support and the slipping layer.

In many instances during thermal dye transfer printing, it would be advantageous to have certain information recorded directly on the thermal dye-transfer element. Examples for potentially useful information would be specific product identification, sensitometric information, recording of the number of print areas remaining on the spool, dye patch position relative to the printer heat line, and so forth.

U.S. Pat. No. 5,342,671 discloses the use of a transparent magnetic layer on a dye-receiver element. However, there is no disclosure in this patent of the use of magnetic layers in a dye-donor element.

In JP 02/054798, a donor element is described for thermal wax transfer which has a magnetic ink layer or patch contiguous to a nonmagnetic thermal transfer layer or patch near the end position for the purpose of detecting the end position. In this element, the magnetic ink layer is coated on the ink side of the donor element and has the same color as the nonmagnetic ink layer next to it. A portion of the magnetic ink may also transfer to the receiving element during the printing process.

There is a problem with the format in this Japanese reference in that the magnetic layer or patch is limited to being located adjacent to an ink layer or patch. For certain types of information, it would be desirable to record information on other areas of a donor material, for example, in the same area as a dye patch. Also, in a thermal dye diffusion transfer process where only the dye is transferred, it would be desirable to not have any magnetic material be transferred to the receiving layer which would affect the density and color balance obtained.

It is an object of this invention to provide a dye-donor element for thermal dye transfer processing which contains a magnetic layer which can be in the same area as the dye layer. It is another object of the invention to provide a dye-donor element for thermal dye transfer processing which contains magnetic material but which is not transferred to the dye-receiving layer which would affect the density and color balance obtained.

This and other objects are achieved in accordance with this invention which relates to a dye-donor element for thermal dye transfer comprising a support having on one side thereof a dye layer and on the other side thereof in the direct opposite area to at least a portion of the dye layer, a magnetic recording layer and a slipping layer, in that order.

The magnetic recording layer used in this invention can comprise a ferromagnetic oxide such as gamma $Fe_2O_3$, gamma $Fe_2O_3$ having a cobalt surface treatment, magnetite, magnetite having a cobalt surface treatment, barium ferrite, chromium dioxide, or a ferromagnetic metal particle such as metallic iron or metallic iron alloys with cobalt, nickel, chromium, etc. All of the above particles may also have a surface treatment with silica, alumina or an alumino-silicate to improve dispersability, corrosion and abrasion resistance. In a preferred embodiment of the invention, gamma $Fe_2O_3$ having a cobalt surface treatment is used.

The above particles may have a coercivity of from about 300 Oersted to about 1500 Oersted, preferably from about 600 Oersted to about 900 Oersted.

The magnetic recording layer of the invention may be present in any concentration which is effective for the intended purpose. In general, good results have been attained using a laydown of from about 0.01 $g/m^2$ to about 4 $g/m^2$, preferably 0.04 $g/m^2$ to about 0.1 $g/m^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikaron Violet RS® (Sumitomo Chemical Co., Ltd.), Dianix Fast Violet 3R FS® (Mitsubishi Chemical Industries, Ltd.), and Kayalon Polyol Brilliant Blue N BGM® and KST Black 146® (Nippon Kayaku Co., Ltd.); azo dyes such as Kayalon Polyol Brilliant Blue BM®, Kayalon Polyol Dark Blue 2BM®, and KST Black KR® (Nippon Kayaku Co., Ltd.), Sumikaron Diazo Black 5G® (Sumitomo Chemical Co., Ltd.), and Miktazol Black 5GH® (Mitsui Toatsu Chemicals, Inc.); direct dyes such as Direct Dark Green B® (Mitsubishi Chemical Industries, Ltd.) and Direct Brown M® and Direct Fast Black D® (Nippon Kayaku Co. Ltd.); acid dyes such as Kayanol Milling Cyanine 5R® (Nippon Kayaku Co. Ltd.); basic dyes such as Sumiacryl Blue 6G® (Sumitomo Chemical Co., Ltd.), and Aizen Malachite Green® (Hodogaya Chemical Co., Ltd.);

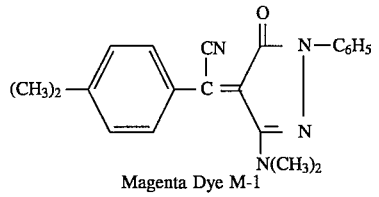

Magenta Dye M-1

-continued

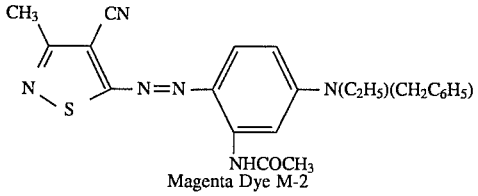

Magenta Dye M-2

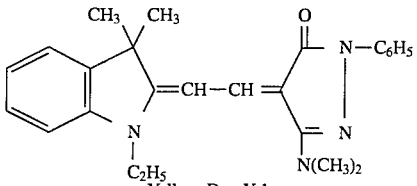

Yellow Dye Y-1

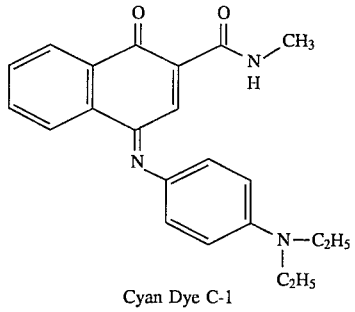

Cyan Dye C-1

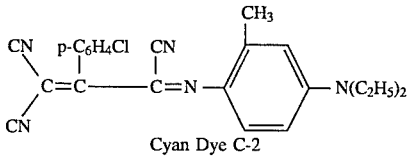

Cyan Dye C-2 or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any slipping layer may be used in the dye-donor element of the invention to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide amides and polyetherimides. The support generally has a thickness of from about 2 to about 30 μm.

The dye-receiving element that is used with the dye-donor element of the invention usually comprises a support having thereon a dye image receiving layer. The support may be a transparent film such as apoly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek®.

The dye image-receiving layer may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise heating a dye-donor element as described above and transferring a dye image to a dye receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head FTP-040 MCSOO1, a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye receiving element being in a superposed relationship with the dye donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process is repeated. The third color is obtained in the same manner.

The following examples are provided to illustrate the invention.

EXAMPLE 1

A dye-donor element was prepared by coating on each side of a 6 μm poly(ethylene terephthalate) support a subbing layer of titanium alkoxide (DuPont Tyzor TBT)® (0.13 g/m$^2$) from a n-propyl acetate and n-butyl alcohol solvent mixture.

The dye formulations listed below were than patch-coated on one side of the above support:

Yellow Layer 0.26 g/m$^2$ Y-1 (see above)

0.27 g/m$^2$ CAP-1 (20 s viscosity cellulose acetate propionate, Eastman Chemical Co.)

0.07 g/m$^2$ CAP-2 (5 s viscosity cellulose acetate propionate, Eastman Chemical Co.)

0.01 g/m$^2$ S363 N-1 (a micronized blend of poly-ethylene, polypropylene, and oxidized polyethylene particles, Shamrock Technologies, Inc.)

0.002 g/m$^2$ FC-430 (a fluorocarbon surfactant from 3M Co.)

solvent: toluene/methanol/cyclopentanone (66.5:28.5:5)

Magenta Layer 0.15 g/m$^2$ M-1 (see above)

0.14 g/m$^2$ M-2 (see above)

0.24 g/m$^2$ CAP-1

0.08 g/m$^2$ CAP-2

0.01 g/m$^2$ S363 N-1

0.002 g/m$^2$ FC-430 same solvent as used for coating yellow layer

Cyan layer 0.38 g/m$^2$ C-1

0.11 g/m$^2$ C-2

0.34 g/m$^2$ CAP-1

0.01 g/m$^2$ S363 N-1

0.002 g/m$^2$ FC-430 same solvent as used for coating yellow layer

Two test samples E-1 and E-2 were prepared by coating a magnetic layer on the back side (opposite to the dye side) of the above donor support. The magnetic coatings were prepared by blending a dispersion of magnetic particles and a dispersion of an abrasive or polishing powder. The procedures for making these dispersions are described below.

Preparation of Magnetic Dispersion

1) A high solids grind was obtained by milling CSF-4085V2, cobalt surface-treated $\gamma$-$Fe_2O_3$ particles obtained from Toda Kogyo Corp., having a nominal coercivity of 850 Oersted, in a low-boiling solvent, di-n-butyl phthalate, and a wetting aid or dispersant (GAFAC® PE-510 organic phosphate surfactant from GAF Corp.) in a 250 cc capacity Eiger mill. The grind was at 35% solids (33.3% magnetic particles CSF 4085V2, 1.67% GAFAC® PE510) and 65% di-n-butyl phthalate. The mill was loaded with 90% V/V 1.0 mm Chromanite steel media, run at 4,000 rev/min with 10° C. coolant for 5 hrs.

2) The high solids grind from 1) above was then diluted as follows:

2.0% cellulose triacetate 2.0% magnetic dispersion 0.1% GAFAC® PE-510

4.0% di-n-butyl phthalate 91.9% methylene chloride using a 4% cellulose triacetate solution in methylene chloride and blending in the remaining material.

Preraration of Abrasive Dispersion

In a 1-gallon glass jar with seal cap, approximately 2,200 g Zr silicate 1.0–1.2 mm diameter mill media was added. Over a hot water bath, 7.5 g Solsperse® 2400 (a dispersant available from Zeneca, Ltd.) was dissolved in 75g of methyl acetoacetate. This was added to the jar containing the mill media together with 367.5 g methyl acetoacetate, 150 g of AKP-50 (α-alumina, particle size ~ 0.25 μm, obtained from Sumitomo Chemical Corp.) and the jar sealed and placed on a roller mill at 100 rev/min for 24 hrs. The median particle size of the abrasive alumina was in the range of 0.2 to 0.3 μm and the material had an equivalent specific surface area of 9–11 g/m$^2$. The dispersion was separated from the mill media by screening.

Coating formulations prepared with the above dispersions were as follows:

E-1

| MATERIAL | % SOLIDS | AIM COVERAGE (g/m$^2$) |
|---|---|---|
| cellulose diacetate | 2.90 | 0.94 |
| magnetic dispersion | 0.18 | 0.06 |
| cellulose triacetate | 0.18 | 0.06 |
| FC-431* | 0.015 | 0.05 |
| Solsperse ® 24000 | 0.0234 | 0.08 |

*FC-431 (a fluorocarbon surfactant from 3M Corp.)

E-2

| MATERIAL | % SOLIDS | AIM COVERAGE (g/m$^2$) |
|---|---|---|
| cellulose diacetate | 2.90 | 0.94 |
| magnetic dispersion | 0.18 | 0.06 |
| cellulose triacetate | 0.18 | 0.06 |
| dibutyl phthalate | 0.349 | 0.12 |
| GAFAC ® PE-510 | 0.009 | 0.003 |
| FC-431 | 0.015 | 0.05 |
| Solsperse ® 24000 | 0.0025 | 0.07 |
| abrasive dispersion | 0.050 | 0.02 |

Test sample E-1 was then provided with a slipping layer of the following composition (coated over the magnetic layer):

0.48 g/m$^2$ KS-1 poly(vinyl acetal) from Sekisui Chemical Corp.

0.0003 g/m$^2$ p-toluenesulfonic acid 0.01 g/m$^2$ PS513® aminopropyl-dimethyl-terminated polydimethylsiloxane, (Petrarch Systems, Inc.)

0.07 g/m$^2$ of a copolymer of poly(propylene oxide) and poly(methyl octyl siloxane), BYK-S732® (98 % in Stoddard solvent) (Byk Chemic) from an 80:20 3-butanone/methanol solvent mixture.

Test sample E-2 was not provided with a slipping layer.

A comparative control sample C-1 was prepared by coating the same support, dye and slipping layers of test sample E-1, but omitting the magnetic backcoat.

EXAMPLE 2

Writeability/readability tests of the magnetic layers of test samples E-1 and E-2 were performed on a Honeywell 7600 reel-to-reel transport at a speed of 4.8 cm/sec. Spin Physics Instrumentation heads were used with trackwidths of 1.25 mm and 2.5 μm gaps. The recording head was wound with 90 turns and the reading head with 480 turns. The output signal from the reading head was amplified by a 70 dB gain low-noise preamplifier and filtered by a 4-pole Butterworth filter with a bandwidth of 7.5 kHz. Characterization of the output signal was performed using a LeCroy 9314L digital oscilloscope. The magnetic recording results are shown as follows:

TABLE 1

| Parameter | E-1 with slipping layer | E-2 without slipping layer |
|---|---|---|
| Optimum record current @ density of 80 flux transitions/mm | 29 mA | 24 mA |
| Isolated Pulse Width | 5.43 μm | 4.93 μm |
| Output Voltage | 48.1 μvolt | 51.4 μvolt |

The above results show that even though the slipping layer degrades the magnetic recording performance to some extent, the medium is still capable of supporting low-density (20–30 bits/mm or >600 bits/inch) information.

EXAMPLE 3

To evaluate printing performance of donor elements according to the present invention, polycarbonate dye receivers were prepared using the following materials:

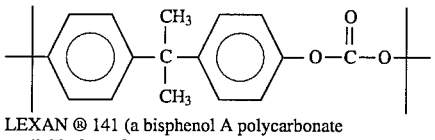

LEXAN ® 141 (a bisphenol A polycarbonate available from General Electric Co.)

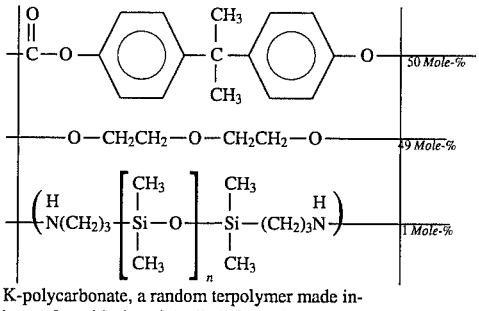

K-polycarbonate, a random terpolymer made in-house from bisphenol A, diethylene glycol, and PS510 (a polydimethylsiloxane available from Huels America)

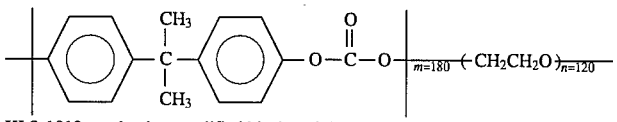

KL3-1013 a polyether-modified bisphenol A polycarbonate available from Bayer AG)

A receiver element was preparedby applying a subbing layer of 0.11 g/m$^2$ of Dow Z-6020 (a water-soluble aminoalkyl-alkoxysilane available from Dow Chemical Co.) in 3A alcohol to a support of a microvoided polypropylene layer laminated onto a white reflective support of titanium dioxide-pigmented polyethylene-overcoated paper stock. A receiving layer of the following composition was coated onto the subbing layer:

1.46 g/m$^2$ Lexan® 141

1.78 g/m$^2$ KL3-1013

0.01 g/m$^2$ FC-431

0.32 g/m$^2$ dibutyl phthalate 0.32 g/m$^2$ methylene chloride

Subsequently, the following overcoat layer was applied to the receiving layer:

0.22 g/m$^2$ K-polycarbonate 0.008 g/m$^2$ DC-510 (a silicone fluid surfactant from Dow-Corning 0.02 g/m$^2$ FC-431 from methylene chloride solvent.

For printing evaluation of E-1 and C-1, the dye side of the dye-donor element strip approximately 10 cm × 13 cm in area was placed in contact with the dye image-receiving element of the same area. The assemblage was clamped to a stepper-motor driven 60 mm diameter rubber roller, and a TDK Thermal Head (no. L-231) (thermostated at 26° C.) was pressed with a force of 36 newtons against the dye-donor element side of the assemblage pushing it against the rubber roller.

The imaging electronics were activated causing the donor/receiver assemblage to be drawn between the printing head and roller at 6.9 mm/s. Coincidentally, the resistive elements in the thermal print head were pulsed for 29 μs/pulse at 128 μs intervals during the 33 msec/dot printing time. An image was generated with regions of varying density by setting the number of pulses/dot for a particular density at a set value between 0 to 255. The voltage supplied to the print head was approximately 23.5 volts, resulting in an instantaneous peak power of 1.3 watts/dot and a maximum total energy of 9.6 mjoules/dot.

The dye transfer element was separated from the receiving element immediately after passing the thermal head. The receiver element was then backed up and the position reinitialized under the head and printed again with the next color. In this way a full color (YMC) image was obtained. The print quality was good in all cases and there were no sticking problems at the donor/thermal head interface.

The Status A densities of the images were measured on an X-Rite densitometer (X-Rite Corp., Grandville, Mich.) and are as follows:

TABLE 2

| Energy (mJ/ | Yellow | | Magenta | | Cyan | |
|---|---|---|---|---|---|---|
| dot) | C-1 | E-1 | C-1 | E-1 | C-1 | E-1 |
| 0 | 0.11 | 0.10 | 0.12 | 0.11 | 0.11 | 0.10 |
| 1.1 | 0.11 | 0.10 | 0.12 | 0.11 | 0.11 | 0.11 |
| 2.1 | 0.11 | 0.10 | 0.12 | 0.11 | 0.11 | 0.11 |
| 3 | 0.14 | 0.12 | 0.15 | 0.12 | 0.14 | 0.12 |
| 4 | 0.36 | 0.31 | 0.34 | 0.30 | 0.32 | 0.30 |
| 4.9 | 0.55 | 0.50 | 0.50 | 0.47 | 0.46 | 0.42 |
| 5.8 | 0.3 | 0.69 | 0.67 | 0.64 | 0.61 | 0.58 |
| 6.8 | 0.96 | 0.91 | 0.87 | 0.84 | 0.81 | 0.79 |
| 7.7 | 1.23 | 1.20 | 1.16 | 1.12 | 1.07 | 1.05 |
| 8.7 | 1.58 | 1.57 | 1.54 | 1.49 | 1.40 | 1.35 |
| 9.6 | 1.99 | 1.97 | 2.40 | 1.96 | 1.80 | 1.74 |

The above results indicate that the addition of a magnetic layer to the opposite side of the dye-donor element in accordance with the invention does not have any appreciable effect on the density of the transferred image.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof a dye layer and on the other side thereof in the direct opposite area to at least a portion of said dye layer, a magnetic recording layer and a slipping layer, in that order.

2. The element of claim 1 wherein said magnetic recording layer is present at a concentration of from about 0.01 to about 4 $g/m^2$.

3. The element of claim 1 wherein said magnetic material is a ferromagnetic oxide or a ferromagnetic metal particle.

4. The element of claim 1 wherein said magnetic material is gamma $Fe_2O_3$ having a cobalt surface treatment.

5. A process of forming a dye transfer image comprising:

(a) imagewise-heating a dye-donor element comprising a support having on one side thereof a dye layer and on the other side thereof in the direct opposite area to at least a portion of said dye layer, a magnetic recording layer and a slipping layer, in that order, and (b) transferring a dye image to a dye-receiving element to form said dye transfer image.

6. The process of claim 5 wherein said magnetic recording layer is present at a concentration of from about 0.01 to about 4 $g/m^2$.

7. The process of claim 5 wherein said magnetic material is a ferromagnetic oxide or a ferromagnetic metal particle.

8. The process of claim 5 wherein said magnetic material is gamma $Fe_2O_3$ having a cobalt surface treatment.

9. A thermal dye transfer assemblage comprising (a) a dye-donor element comprising a support having on one side thereof a dye layer and on the other side thereof in the direct opposite area to at least a portion of said dye layer, a magnetic recording layer and a slipping layer, in that order, and (b) a dye-receiving element comprising a support having thereon a dye image-receiving layer, said dye-receiving element being in a superposed relationship with said dye-donor element so that said dye layer is in contact with said dye image-receiving layer.

10. The assemblage of claim 9 wherein said magnetic recording layer is present at a concentration of from about 0.01 to about 4 $g/m^2$.

11. The assemblage of claim 9 wherein said magnetic material is a ferromagnetic oxide or a ferromagnetic metal particle.

12. The assemblage of claim 9 said magnetic material is gamma $Fe_2O_3$ having a cobalt surface treatment.

* * * * *